US012018869B2

(12) United States Patent
Lord

(10) Patent No.: US 12,018,869 B2
(45) Date of Patent: Jun. 25, 2024

(54) SYSTEM AND METHOD FOR MITIGATING RISK FROM A LEAKED REFRIGERANT AT EVAPORATOR COILS

(71) Applicant: Carrier Corporation, Palm Beach Gardens, FL (US)

(72) Inventor: Richard G. Lord, Murfreesboro, TN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/253,248

(22) PCT Filed: Sep. 10, 2020

(86) PCT No.: PCT/US2020/050035
§ 371 (c)(1),
(2) Date: Dec. 17, 2020

(87) PCT Pub. No.: WO2021/050618
PCT Pub. Date: Mar. 18, 2021

(65) Prior Publication Data

US 2022/0307740 A1 Sep. 29, 2022

Related U.S. Application Data

(60) Provisional application No. 62/898,818, filed on Sep. 11, 2019.

(51) Int. Cl.
*F25B 39/02* (2006.01)
*F24F 1/0059* (2019.01)
(Continued)

(52) U.S. Cl.
CPC ..... *F25B 39/02* (2013.01); *F24F 1/0059* (2013.01); *F24F 11/36* (2018.01); *F25B 49/005* (2013.01);
(Continued)

(58) Field of Classification Search
CPC ..... F25B 39/02; F25B 39/028; F25B 49/005; F25B 2500/22; F25B 2500/221;
(Continued)

(56) References Cited

U.S. PATENT DOCUMENTS 324,229 A * 8/1885 Chase ..... F25D 3/06 62/424
3,425,264 A * 2/1969 Frei ..... G01M 3/228 376/250
(Continued)

FOREIGN PATENT DOCUMENTS

JP 5642648 B2 * 12/2014
WO WO-2018012489 A1 * 1/2018 ..... F24F 11/36

OTHER PUBLICATIONS

JP-5642648-B2 English translation (Year: 2014).*
WO-2018012489-A1 English translation (Year: 2018).*
ISR/WO; PCT/US2020/050035; mailed Dec. 2, 2020; 15 pages.

*Primary Examiner* — David J Teitelbaum
*Assistant Examiner* — Devon Moore
(74) *Attorney, Agent, or Firm* — CANTOR COLBURN LLP

(57) ABSTRACT

Disclosed is a heat exchanger assembly including: a coil; one baffle connected to a first end of the coil, the one baffle being configured to capture a liquid refrigerant that has leaked from the coil, the one baffle being configured to direct the liquid refrigerant toward a first end of a drain pan.

6 Claims, 3 Drawing Sheets

(51) Int. Cl.
*F24F 11/36* (2018.01)
*F25B 49/00* (2006.01)

(52) U.S. Cl.
CPC ... *F25B 2500/221* (2013.01); *F25B 2500/222* (2013.01)

(58) Field of Classification Search
CPC . F25B 2500/222; F24F 11/36; F24F 11/0059; F24F 11/0067; F24F 11/0068
See application file for complete search history.

(56) References Cited

U.S. PATENT DOCUMENTS

| | | | | |
|---|---|---|---|---|
| 4,114,397 | A * | 9/1978 | Takahashi | F25B 39/02 165/158 |
| 6,536,225 | B1 | 3/2003 | Yajima | |
| 2007/0169498 | A1 | 7/2007 | Rios | |
| 2007/0169499 | A1 | 7/2007 | Rios et al. | |
| 2007/0227171 | A1* | 10/2007 | McMillan | F24F 5/0035 62/291 |
| 2016/0334129 | A1* | 11/2016 | Shinoda | F25B 39/02 |

* cited by examiner

SYSTEM AND METHOD FOR MITIGATING RISK FROM A LEAKED REFRIGERANT AT EVAPORATOR COILS

CROSS REFERENCE TO RELATED APPLICATIONS

This application is a Non-Provisional Application of PCT/US2020/050035 filed Sep. 10, 2020, which claims the benefit of U.S. Application No. 62/898,818 filed Sep. 11, 2019, the disclosure of which is incorporated herein by reference in its entirety.

BACKGROUND

The presently disclosed embodiments generally relate to heating, ventilation, air conditioning, and refrigeration (HVAC) systems, and more particularly, to a system and method for mitigating risk from a leaked refrigerant, wherein the indoor section of a unit that could leak into the occupied space.

Refrigeration systems, as used in HVAC applications, utilize a closed loop refrigerant circuit to condition air inside an interior space of a building. Over the years, the HVAC industry has been using refrigerants with high Global Warning Impact (GWP) levels; however, the use of these refrigerants are currently being phased out by environmental regulations like the Kigali agreement due to their inherent high Global Warming Impact (GWP).

New refrigerants have been developed to comply with environmental regulations relating to global warming potential (GWP). In order to comply with the proposed GWP regulations, hydrofluorocarbon (HFC) and Hydrofluro-Olefins (HFO) that are mildly flammable are being developed and are being considered for use in lower GWP refrigerant HVAC systems.

As with any system, there is a potential fir the low flammability refrigerants used in HVAC applications to leak and migrate to undesirable areas in the vicinity of the HVAC system and building. When the flammable refrigerants, in the presence of air or another oxidizer, are exposed to an ignition source, the potential for a combustion event may be minimized if the mixture is kept below a lower flammability limit (LFL).

SUMMARY OF THE DISCLOSED EMBODIMENTS

Disclosed is a heat exchanger assembly including: a coil; one baffle connected to a first end of the coil, the one baffle being configured to capture a liquid refrigerant that has leaked from the coil, the one baffle being configured to direct the liquid refrigerant toward a first end of a drain pan.

In addition to one or more of the above disclosed aspects or as an alternate the heat exchange assembly includes another baffle connected to a second end of the coil, the other baffle being configured to direct the liquid refrigerant toward a second end of the drain pan.

In addition to one or more of the above disclosed aspects or as an alternate the first end of the coil includes a coil header and the second end of the coil includes a hairpin.

In addition to one or more of the above disclosed aspects or as an alternate the heat exchange assembly includes a first baffle at the first end of the coil and a second baffle at the second end of the coil, wherein the one baffle is a third baffle and the another baffle is a fourth baffle.

In addition to one or more of the above disclosed aspects or as an alternate the first baffle is connected to a top side of the coil at the first side of the coil, and the third baffle is connected to a bottom side of the coil at the first side of the coil; and the second baffle is connected to the top side of the coil at the second side of the coil, and the fourth baffle is connected to the bottom side of the coil at the second side of the coil.

In addition to one or more of the above disclosed aspects or as an alternate in an end-to-end direction for the coil, the third baffle has a span that is less than a span of the baffle, thereby exposing at least a portion of the coil header.

In addition to one or more of the above disclosed aspects or as an alternate in the end-to-end direction for the coil, the fourth baffle has a span that is the same as or greater than a span of the second baffle.

In addition to one or more of the above disclosed aspects or as an alternate one or both of the third baffle and the fourth baffle is a flat plate.

In addition to one or more of the above disclosed aspects or as an alternate the heat exchange assembly includes a drain pan, the coil being seated in the drain pan, the drain pan configured to receive the liquid refrigerant from the third baffle and the fourth baffle when the liquid refrigerant has leaked from the first end or the second end of the coil and is captured by the third baffle or the fourth baffle.

In addition to one or more of the above disclosed aspects or as an alternate floor of the drain pan is skewed at an angle so that the first end of the drain pan is lower than the second end of the drain pan, whereby when liquid refrigerant has drained into the second end of the drain pan, the liquid refrigerant is directed to the first end of the drain pan.

In addition to one or more of the above disclosed aspects or as an alternate the heat exchange assembly includes a sensor operationally connected to the first end of the coil, the sensor configured for sensing the liquid refrigerant.

In addition to one or more of the above disclosed aspects or as an alternate the sensor is disposed at the header between the third baffle and the first baffle, whereby the sensor is configured to sense liquid refrigerant captured at the third baffle.

In addition to one or more of the above disclosed aspects or as an alternate the sensor is disposed proximate the first end of the drain pan, whereby the sensor is configured to sense liquid refrigerant captured by the fourth baffle that has been received at the second end of the drain pan and directed within the drain pan to the first end of the drain pan.

Further disclosed is an indoor HVAC assembly including: a housing, and a heat exchanger assembly having one or more of the above disclosed aspects.

In addition to one or more of the above disclosed aspects or as an alternate the assembly includes a fan disposed with the housing, the fan configured to provide an airflow across the heat exchanger assembly.

In addition to one or more of the above disclosed aspects or as an alternate the assembly includes a system controller that communicates with the sensor, the system controller configured to: receive a signal from the sensor, wherein the signal is indicative of a refrigerant leak; and operate the fan responsive to receiving the signal.

In addition to one or more of the above disclosed aspects or as an alternate the system controller is configured to deactivate a compressor responsive to receiving the signal.

Further disclosed is a method of operating an air conditioning system, including: receiving a signal from a sensor disposed on a heat exchanger assembly, the signal being indicative of a refrigerant leak, wherein the sensor is disposed adjacent to one baffle at a fan coil header of a coil, the one baffle being configured to capture refrigerant that has leaked from the coil, the one baffle being configured to direct the refrigerant toward a first end of a drain pan; and activate the fan responsive to receiving the signal.

In addition to one or more of the above disclosed aspects or as an alternate the method includes deactivating a compressor responsive to receiving the signal.

In addition to one or more of the above disclosed aspects or as an alternate the heat exchanger assembly includes another baffle connected to a second end of the coil, the other baffle being configured to direct the refrigerant toward a second end of the drain pan.

BRIEF DESCRIPTION OF DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
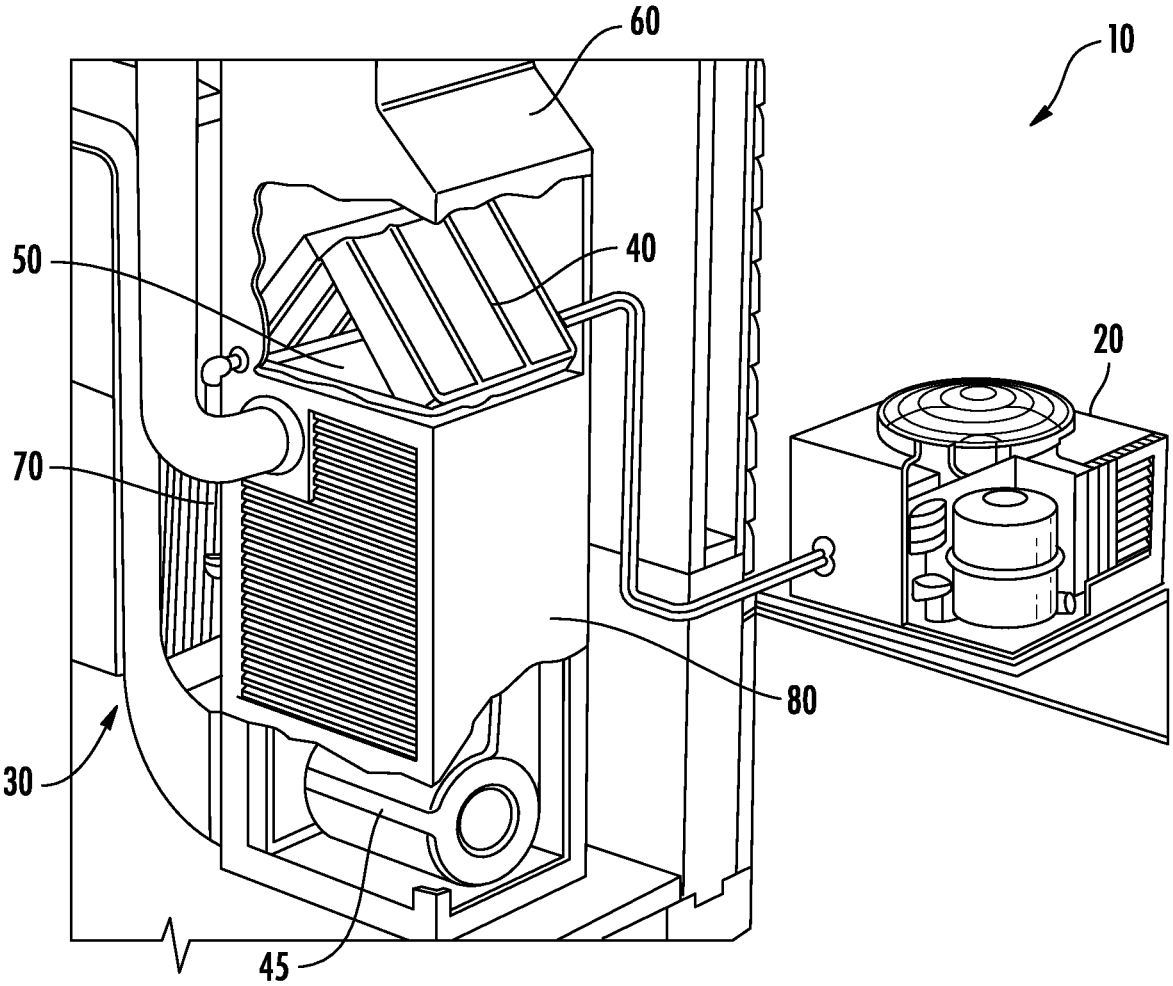
FIG. 1 is a schematic diagram of an HVAC system which may utilize features of the disclosed embodiments.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an air conditioning (AC) system 10. The configuration of FIG. 1 can be used in a number of applications, such as in residential systems. When used with a residential system, the system 10 includes an outdoor HVAC assembly 20 which may include a compressor. The outdoor HVAC 20 assembly operates as a condenser. The system 10 further includes an indoor HVAC assembly 30 that operates as an evaporator to distribute conditioned air within a structure. The illustrated example shows the indoor HVAC assembly 30 as a furnace/cased coil combination. However, it will be appreciated that the indoor HVAC assembly 30 may also be a fan coil to name one non-limiting example.

The indoor HVAC assembly 30 includes an indoor heat exchanger (coil) 40, a blower 45, and evaporator drain lines 70. The indoor heat exchanger 40 may be formed from a microchannel heat exchanger or a round tube plate fin heat exchanger and may be configured as a slab coil as shown, an A-coil configuration or other configuration. The indoor heat exchanger 40 is disposed over a drain pan 50, which may also be referred to as a condensate receptor, and configured to collect condensate from the indoor heat exchanger 40.

With the requirements to move to lower GWP refrigerants it is likely that mildly flammable refrigerants, referred to in the art as "A2L refrigerants" and defined in standards like ASHRAE 34, will be used. New safety standard and building code that have been developed for the use of A2L refrigerants require utilizing a refrigerant sensor that should respond to low as well as high leaks. A2L refrigerants as well as most refrigerants are heavier than air and tend to drop in the unit, but also as the refrigerant leaks it can induce airflow as well as change the average density of the air refrigerant mixture and cause airflow and the refrigerant not to concentrate impacting the ability to detect low leak refrigerant leaks. A structure is needed to prevent such refrigerants from being drawn out of the area where the sensor is located due the above mentioned induced airflow and migration of the heavier than air refrigerant.

Figure 2:
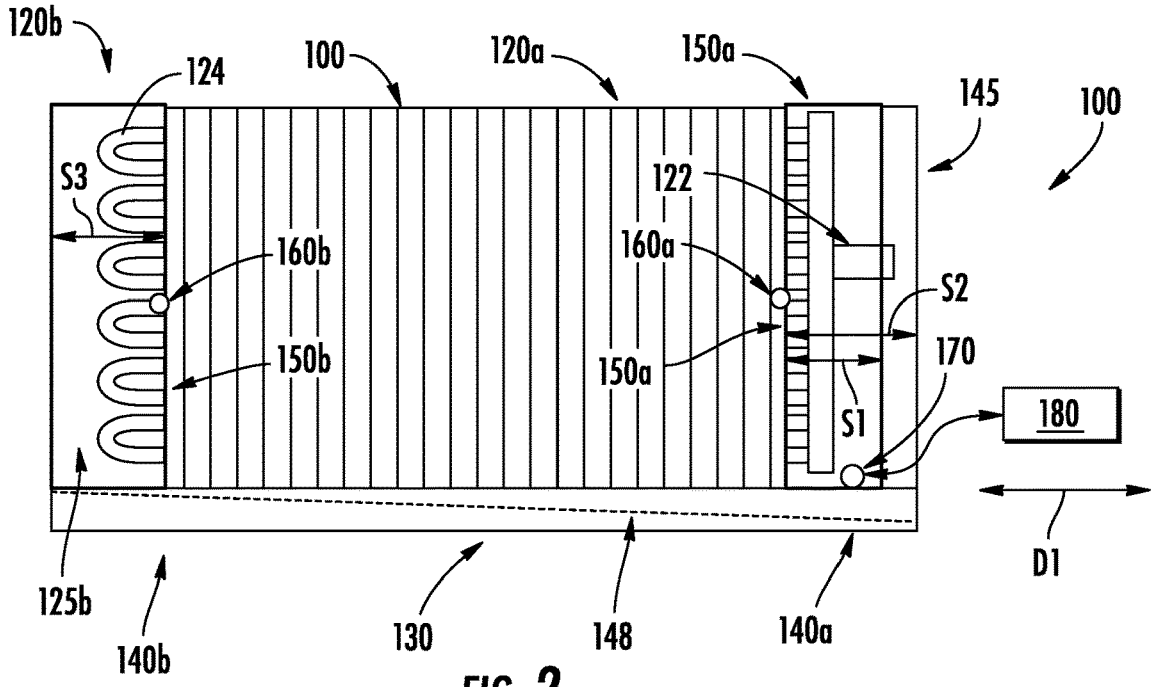
FIG. 2 shows a front view of a coil assembly with baffles according to an embodiment.
Figure 3:
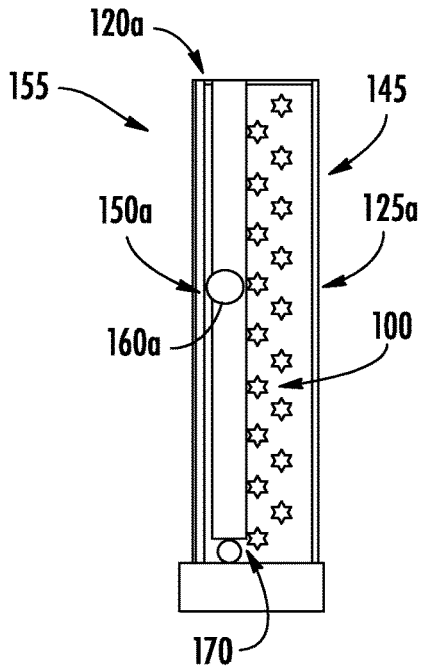
FIG. 3 shows a side view of the coil assembly of FIG. 2.
Figure 4:
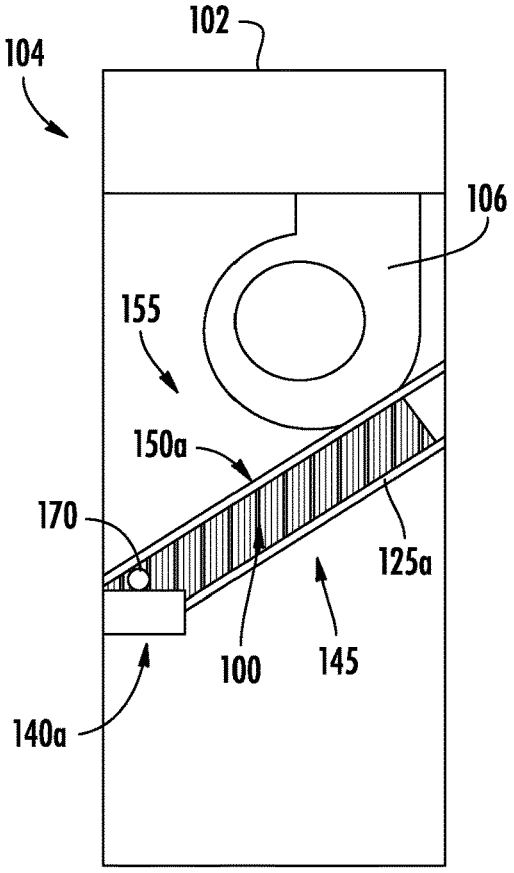
FIG. 4 shows a schematic view of an HVAC assembly, showing therein the side view of the coil assembly.

Turning to FIGS. 2-4, a heat exchanger assembly 100 is illustrated which may be utilized with an indoor HVAC assembly 104 (FIG. 4). The heat exchanger assembly 100 may be installed within a housing 102 (FIG. 4) of the indoor HVAC assembly 104. The heat exchanger assembly 100 may also be installed within a separate housing (shown in FIG. 1) as part of the indoor HVAC assembly 104. In the current embodiment of FIG. 4, the indoor HVAC assembly 104 includes a fan 106 (FIG. 4) located downstream of the heat exchanger assembly 100. It will be appreciated that the fan 106 may also be positioned upstream of the heat exchanger assembly 100.

The heat exchanger assembly 100 includes a coil 110. The coil 110 may be round tube plate fin or microchannel coil. It is to be appreciated that benefits of the disclosed embodiments may be applied to all types of heat exchangers. The coil 110 includes a first end 120*a* and a second end 120*b*. Both ends are illustrated in FIG. 2 while one end is illustrated in FIGS. 3 and 4. The first end 120*a* of the coil may include coil headers 122. The second end 120*b* of the coil 110 may include return bends otherwise known as hairpins 124.

A first baffle 125*a* is attached to a bottom side 145 of the coil 110 at the first end 120*a* of the coil 110. A second baffle 125*b* is attached to the bottom side 145 the coil 110 at the second end 120*b* of the coil 110. A drain pan 130 is disposed below the coil 110. It will be appreciated that the drain pain 130 may be positioned in different locations based on the orientation of the indoor HVAC assembly 104, The drain pan 130 includes a first end 140*a* and a second end 140*b* extending between the first end 120*a* and the second end 120*b* of the coil 110. A floor 148 of the drain pan 130 is skewed at an angle. Thus the first end 140*a* of the drain pan 130 is lower than the second end 140*b* of the drain pan 130. From this, when fluid has drained into the other end 140*b* of the drain pan 130, the fluid is directed to the first end 140*a* of the drain pan 130.

According to an embodiment the assembly 100 may include a third baffle 150*a* and a fourth baffle 150*b* (alternatively referred one baffle and another baffle). The third baffle 150*a* may be connected to a top side 155 of the coil 110 at the first end 120*a*, of the fan coil 110. The third baffle 150*a* may be connected to structure of the coil 110, including coil tube-sheets or other typical fan coil structure. The connection maybe a first clip 160*a*.

According to an embodiment a sensor 170 is operationally connected to the first end 120*a* of the coil 110. The sensor 170 configured for sensing vapor refrigerant. The sensor 170 is disposed between the third baffle 150*a* and the first baffle 125*a* at the header 122.

The third baffle 150*a* is configured to focus or concentrate at the sensor 170 any refrigerant that has leaked in the form of vapor from the fan coil 110, which may otherwise be carried away by action of the fan 106 or natural convection.

The sensor 170 is effective when the indoor HVAC assembly 104, including the fan 106, is off as once the fan 106 is energized the air dilutes the refrigerant. If the indoor HVAC assembly 104 is off and there is a leak the sensor 170 will detect the leak. The baffles focus the leaking refrigerant to the area of the sensor 170 and increase the sensitivity. Once the sensor 170 has detected the leak the fan 106 is energized and the compressor, e.g., in the outdoor HVAC assembly 20 is prevented from running to purge and dilute the refrigerant. The baffles help concentrate the leaking refrigerant and accelerate and improve the detection of leaking refrigerant.

The fourth baffle 150*b* may be connected to the top side 155 of the coil 110 at the second end 120*b* of the coil 110. The fourth baffle 150*b* may be connected to structure of the coil 110, including coil tube-sheets or other typical fan coil structure. The connection may be by a second clip 160*b*. The fourth baffle 150*b* is configured to capture refrigerant that has leaked from the coil 110 and otherwise may be carried away by action of the fan 106 or natural convection. Once captured, the fourth baffle 150*b* is configured to direct the fluid downwardly, toward the second end 140*b* of the drain pan 130. In addition, fluid not directed downwardly by the fourth baffle 150*b* will flow downwardly by gravity into the second end 140*b* of the drain pan 130. From there, due to the skewed angle of the floor 148 of the drain pan 130, the fluid that drains into the second end 140*b* of the drain pan 130 will be directed to the first end 140*a* of the drain pan 130.

According to an embodiment, in end-to-end direction D1 for the fan coil 110, the third baffle 150*a* has a span S1 that is less than a span S2 of the first baffle 125*a*. This configuration exposes at least a portion of the fan coil header 122 in the end-to-end direction D1 the housing 102 that is exposed to the fan 106 for cooling purposes, e.g., to receive a natural or forced cooling airflow.

In the end-to-end direction D1 for the coil 110, the fourth baffle 150*b* has a span S3 that is the same as or greater than a span (not labeled) of the hairpin 124. This enables capturing a relative maximum amount of fluid that may be leaking from the second end of the fan coil 110. Due to the sizing of the second baffle 125*b* and the fourth baffle 150*b*, the hairpin side is fully enclosed so that refrigerant that leaks will fall down into the drain pain and run the along the hairpin side. With the partial width of the third baffle 150*a* relative to the first baffle 125*a* when the fan is running it will slowly vent the area. In addition, there is some leakage thru the first and second baffles 125*a*, 125*b* and there is a pressure drop thru the coil 110*a*, so some air will bypass the coil thru these baffles.

According to an embodiment, one or both of the third baffle 150*a* and the fourth baffle 150*b* may be a flat plate. The one or both of the third baffle 150*a* and the fourth baffle 150*b* may be plastic.

The sensor 170 may be disposed proximate the first end 140*a* of the drain pan 130. From this configuration the sensor 170 is configured to sense fluid captured by the fourth baffle 150*b* that has been received at the second end 140*b* of the drain pan 130 and directed within the drain pan 130 to the first end 140*a* of the drain pan 130.

A system controller 180 illustrated schematically is provided for the air conditioning system 10. The system controller 180 may communicate with the sensor 170. The system controller 180 may be configured to receive a signal from the sensor 170 when the sensor 170 senses a fluid leak. The system controller 180 may be configured to shut-off the system 10 responsive to receiving the signal. This would minimize or prevent further fluid leakage.

Figure 5:
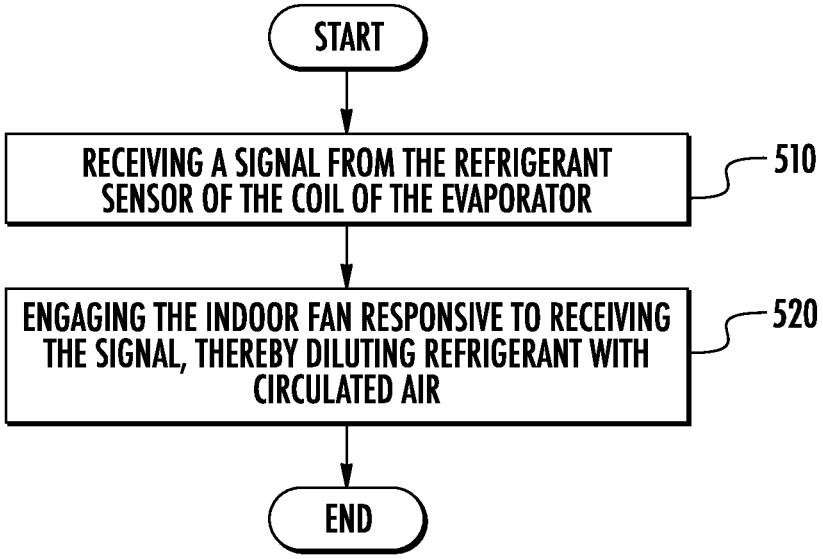
FIG. 5 is a flowchart showing a method of operating an air conditioning system.

As shown in FIG. 5, a flowchart shows a method of operating the air conditioning system 10. As illustrated in block 510, the method includes the system controller 180 receiving a signal from the sensor 170 of the coil 110 of the indoor HVAC assembly 104. The signal is indicative of detecting a refrigerant leak. As indicated, the sensor 170 is disposed between the first baffle 125*a* and the third baffle 150*a* at the coil header 122. The third baffle 150*a* is configured to capture fluid that has leaked from the coil 110. The third baffle 150*a* is configured to direct the fluid downwardly, toward the first end 140*a* of the drain pan 130. As illustrated in block 520, the method includes the controller 180 energizing the fan 106 and shutting-off the outdoor HVAC assembly 20, i.e., the compressor, responsive to receiving the signal.

The above disclosed embodiments enable leaking refrigerant to concentrate relatively quickly, improving a response time of the sensor 170.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An indoor HV AC assembly comprising:

a housing;

a fan within the housing and configured to provide an airflow; and a heat exchanger assembly within the housing, the heat exchanger assembly comprising:

a drain pan extending from a first end to a second end that are spaced apart from each other in a width direction for the assembly:

a coil seated in the drain pan, the coil having a top side, a bottom side, and extending from a first end to a second end that are spaced apart from each other in the width direction for the assembly, wherein the first end of the coil includes a coil header and the second end of the coil includes a hairpin;

a first baffle connected to the top side of the coil at the first end of the coil, a second baffle connected to the top side of the coil at the second end of the coil, a third baffle that is a flat plate connected to the bottom side of the coil at the first end of the coil, the third baffle being configured to capture a liquid refrigerant that has lea ked from the coil, the third baffle being configured to direct the liquid refrigerant toward the first end of the drain pan, and a fourth baffle that is another flat plate connected to the bottom side of the coil at the second end of the coil, so that the third and fourth baffles are spaced apart from each other in the width direction for the assembly, the fourth baffle being configured to direct the liquid refrigerant toward the second end of the drain pan, wherein the drain pan is configured to receive the liquid refrigerant from the third baffle and the fourth baffle when the liquid refrigerant has lea ked from the first end or the second end of the coil and is captured by the third baffle or the fourth baffle, the drain pan includes a floor that is disposed at an angle so that the first end of the drain pan is lower than the second end of the drain pan, whereby when the liquid refrigerant has drained into the second end of the drain pan, the liquid refrigerant flows along the floor of the drain pan toward the first end of the drain pan;

a sensor connected to the first end of the coil, at the header, between the third baffle and the first baffle, proximate the first end of the drain pan, and the sensor is configured for sensing the liquid refrigerant captured at the third baffle at the first end of the drain pan and the liquid refrigerant captured by the fourth baffle at the second end of the drain pan and has flowed along the floor of the drain pan to the first end of the drain pan, wherein the sensor is configured to sense an air refrigerant mixture and transmit a signal indicative of a refrigerant leak;

wherein in the width direction for the assembly:

the fourth baffle has a span that is the same as or greater than a span of the second baffle; and the third baffle has a span that is less than a span of the first baffle, there by exposing at least a portion of the coil header to the fan.

2. The assembly of claim 1, comprising:

a system controller that communicates with the sensor, the system controller configured to:

receive a signal from the sensor, wherein the signal is indicative of a refrigerant leak; and operate the fan responsive to receiving the signal.

3. The assembly of claim 2, wherein the system controller is configured to deactivate a compressor responsive to receiving the signal.

4. A method of operating the indoor HVAC assembly of claim 3, comprising:

receiving a signal from the sensor disposed on the heat exchanger assembly, the signal being indicative of a refrigerant leak; and activate the fan responsive to receiving the signal.

5. The method of claim 4, comprising deactivating the compressor responsive to receiving the signal.

6. The assembly of claim 1, wherein the assembly includes clips and the third and fourth baffles are clipped to the assembly via the clips.

* * * * *